United States Patent [19]

Carlson

[11] 4,004,382

[45] Jan. 25, 1977

[54] HANGAR FACILITY

[75] Inventor: Carl V. Carlson, Batavia, Ill.

[73] Assignee: R & D Constructors, Inc., Park Ridge, Ill.

[22] Filed: May 30, 1975

[21] Appl. No.: 582,369

[52] U.S. Cl. ..... 52/64; 52/236.1

[51] Int. Cl.[2] ..... E04B 1/346

[58] Field of Search ..... 52/64, 237; 244/114 R

[56] References Cited

UNITED STATES PATENTS

| | | | |
|---|---|---|---|
| 3,034,607 | 5/1962 | Haines | 52/64 |
| 3,739,537 | 6/1973 | Barnes | 52/237 |
| 3,838,879 | 10/1974 | Lilly | 244/114 R |

FOREIGN PATENTS OR APPLICATIONS

| | | | |
|---|---|---|---|
| 25,017 | 11/1910 | United Kingdom | 52/64 |

*Primary Examiner*—John E. Murtagh

*Attorney, Agent, or Firm*—Merriam, Marshall, Shapiro & Klose

[57] ABSTRACT

A hangar for aircraft having a tail section, fuselage and wing portions, in which the hangar includes a front section having a roof with a movable portion which normally overlies an opening in the roof through which the tail section of an aircraft can pass as it moves through the hangar. The hangar further includes a second or tail section having side walls and a front and back wall. The height of the roof of the second section is greater than the height of the roof of the front section. The front wall of the second section has an opening therein to allow the tail section of an aircraft to pass into or out of the second hangar section.

11 Claims, 9 Drawing Figures

10
11
12
13
14
15
16
17
19
20
21
22
24
25
26
27
28
29
30
31
32
9
4

HANGAR FACILITY

BACKGROUND OF THE INVENTION

1. Field of the Invention

This invention relates to a new and improved storage and maintenance facility for vehicles and more particularly to a hangar facility in which aircraft are stored or maintained. The hangar facility of the present invention includes a first or front section in which the fuselage and wing portions of an aircraft are located and a second section in which the tail section of the craft is normally positioned when an aircraft is stored or maintained in the hangar. The second section has a roof or ceiling which is of a height greater than the height of the roof of the first section. The roof section of the frist hangar section has a movable portion which overlies an open area in the roof through which the tail section of an aircraft can pass as a plane is moved through the front section of the hangar.

2. Description of the Prior Art

Aircraft, and particularly those which are used commercially for the transporting of passengers and cargo, are routinely withdrawn from service for maintenance and other service. Often these craft are positioned in large hangar areas where the servicing of the aircraft is undertaken.

Hangar facilities are designed in some instances so that the major portion of the roof of the hangar facility is of a height greater than the height of the tail of the aircraft to be stored or maintained. Accordingly, as the size of the aircraft has increased over the years, the size of hangar structures has also increased. The height and other dimensions of hangar facilities have become greater thereby causing a significant increase in the construction costs of a hangar.

In another hangar design, the hangar comprises a section in which the fuselage and wing of the craft are positioned. It also includes a second section in which the tail section of the aircraft is normally located for storage and maintenance purposes. The height of the second section is greater than the height of the tail of the aircraft to be positioned in that section and is greater in height than the height of the hangar section in which the fuselage and wing portions are located. This hangar design has not been completely satisfactory. It has been found that when this hangar is used to service aircraft the aircraft to be serviced must be moved into the hangar so that the nose end of the craft will first enter the hangar tail section. The aircraft then continues moving into the hangar until the fuselage and wing portions of the plane are disposed in the fuselage section of the hangar while the tail section of the aircraft is positioned in the tail section of the hangar.

Once the aircraft is positioned in the hangar, maintenance docks or stations are erected about various portions of the aircraft to provide an appropriate work area for mechanics and other personnel who service the aircraft. The maintenance docks are often quite large and require a considerable amount of time to erect. After the maintenance work has been completed, the aircraft is then removed from the hangar.

The plane is withdrawn from this hangar structure with the tail of the plane exiting first and the wing and fuselage portions being withdrawn last. Unfortunately, with this type of arrangement the maintenance docks or stations must be substantially disassembled or removed in order that the plane can be pulled from the hangar without damage. It can be appreciated that the time and labor associated with erecting and disassembling maintenance docks, which often involve massive riggings and scaffolding, is quite costly.

What is desired is a hangar facility which can accommodate different size aircraft in a relatively small area. Specifically, it is desired to eliminate the problems associated with hangar facilities in which the ceilings of the hangar are too high.

It is also desired to have a hangar facility which will not require the disassembly or withdrawal of all the maintenance dock stations following servicing of the aircraft before the aircraft can be removed from the hangar. It is desired that the maintenance stations be left substantially in place. This is desired particularly with the maintenance docks located at the tail section of the aircraft.

SUMMARY OF THE INVENTION

The present invention serves to obviate the problems associated with prior art hangar facilities. The present invention involves a hangar facility in which an aircraft to be serviced or maintained is backed into the hangar so that the tail of the craft enters the hangar before the fuselage and wing portions of the plane.

The hangar includes a first or front section which includes a roof having a portion thereof which is movable to expose an open area along the length of the front section through which the tail of an aircraft passes as it is backed into or out of the hangar.

The preferred embodiment of the first section includes two diverging front walls which are movable relative to each other in a direction toward the rear of the front section so that the wings of the plane can enter into the hangar.

The hangar facility also includes a second section which includes a pair of side walls, front and back walls and a roof which is of a height greater than the height of the roof of the first section and greater than the height of the tail of the aircraft to be stored or maintained in the hangar. The front wall of the second section has an opening to permit the tail of an aircraft to enter into or exit from the second section of the hangar of the present invention.

The second section of the hangar further includes a tail section maintenance dock which remains substantially in position and need not be moved out of position when an aircraft is removed from the second section after it has been serviced. The maintenance dock is adjustable in order to provide the necessary work areas associated with different size and designs of aircraft.

BRIEF DESCRIPTION OF THE DRAWINGS

The advantages of the present invention will become further apparent in conjunction with the accompanying drawings in which.

DESCRIPTION OF THE INVENTION

Figures 1, 2, 3:
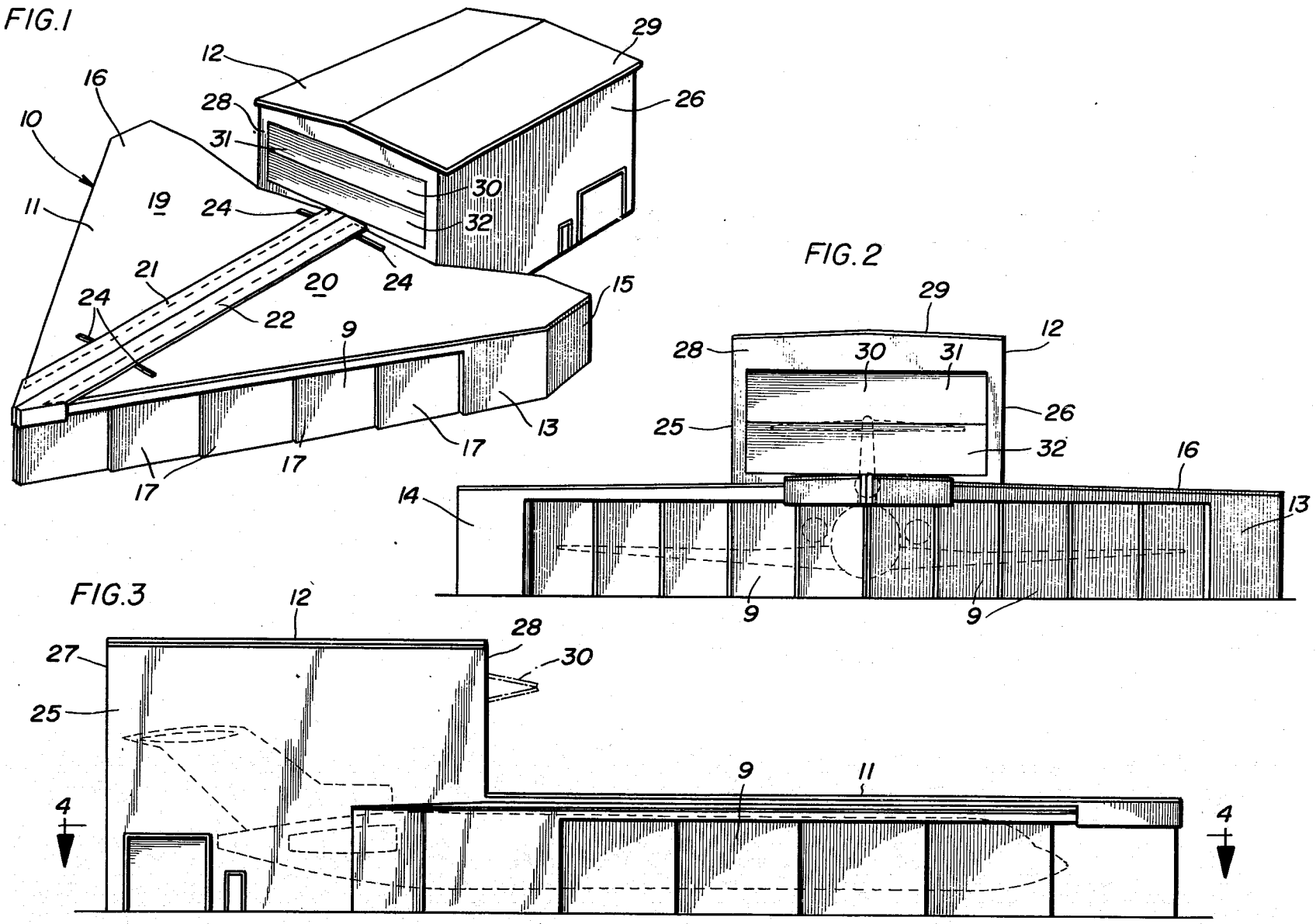
FIG. 1 shows a perspective view of the hangar facility of the present invention.
FIG. 2 shows a front view of the hangar facility of the present invention.
FIG. 3 shows a side view of the hangar of FIG. 2 with the front wall of the hangar section in a retracted position.

Referring to the drawings and FIGS. 1–5, hangar facility 10 is shown which comprises a front or first section 11 and a second or tail section 12.

Figure 4:
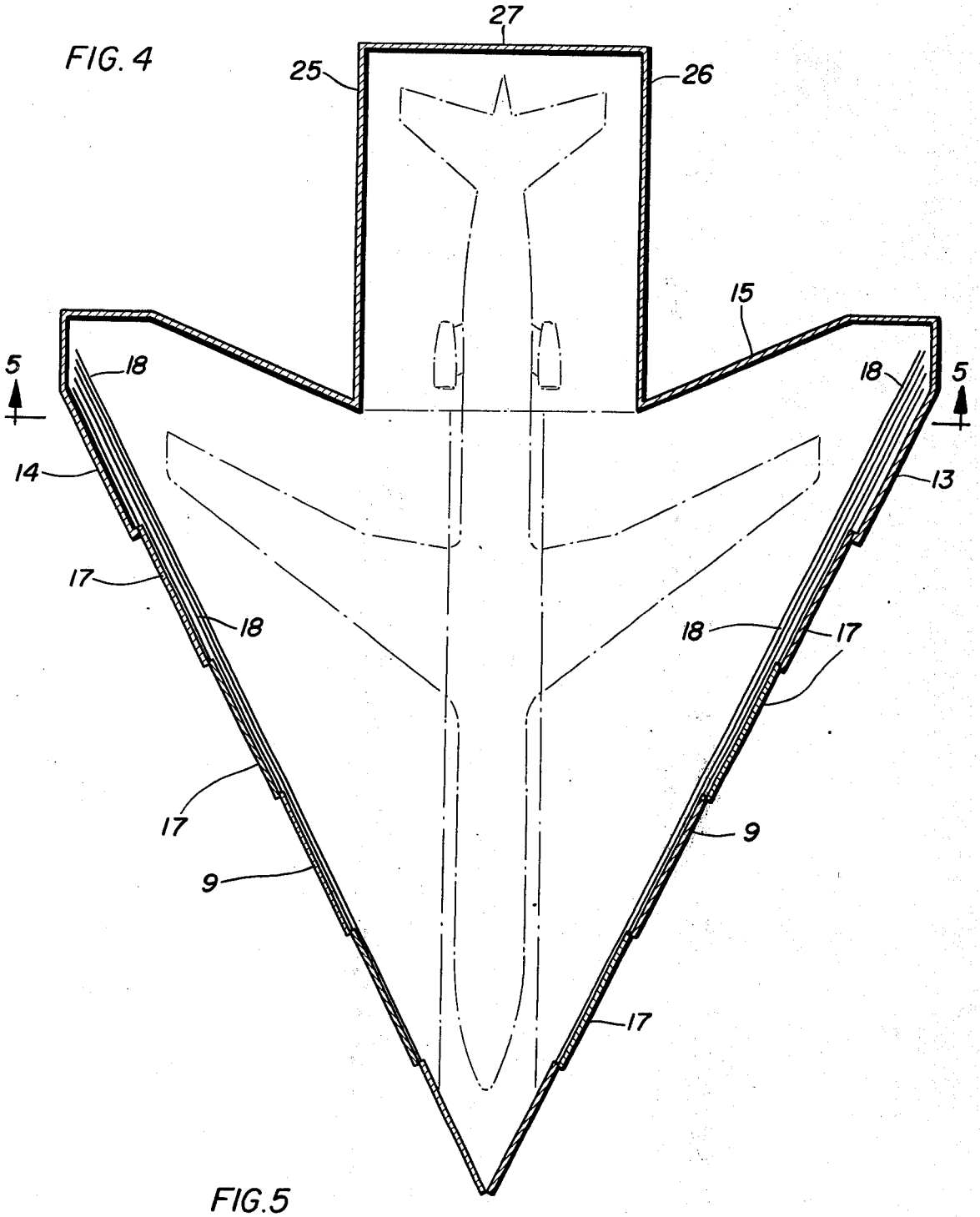
FIG. 4 shows a plan section view taken along the lines 4—4 in FIG. 3.

The front section includes a pair of diverging front walls 13,14, a back wall 15 and a roof 16. Front section 11 is designed to house the wings and fuselage portions of an aircraft as illustrated in FIGS. 3 and 4.

Each of the front walls include a movable door 9 which is adapted to move rearward toward back wall 15. As shown more clearly in FIGS. 1 and 4, the front wall door member includes a plurality of telescoping sections 17, which ride in tracks 18 so that the front walls 13,14 can be opened to allow the wing portions of an aircraft to enter the hangar facility 10. Preferably, front section 11 is delta shaped to conserve size and space, however, the hangar is adapted to accommodate different types and sizes of aircraft. The hangar walls can be made of any suitable construction material such as corrugated metal panels which are commonly used in building construction. Similarly, while the doors 9 are shown as utilizing telescoping sections 17, it is appreciated that other door designs could be employed.

Figure 5:
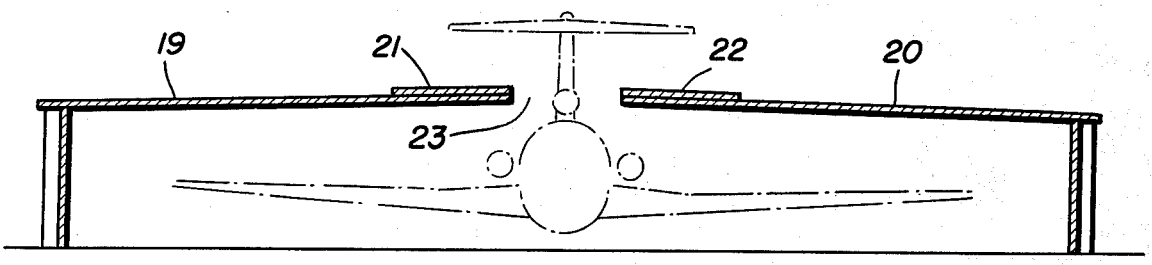
FIG. 5 shows a section view taken along the lines 5—5 in FIG. 4.

Roof 16 includes stationary portions 19,20. Movable roof members 21,22 are adapted to overlie an opening 23 through which a tail section of an aircraft can pass, as illustrated in FIG. 5. Opening 23 in roof 16 is of a width sufficient to allow tail sections of different aircraft to pass through section 11. The opening extends along the entire length of roof 16 as shown in dotted lines in FIG. 1. Roof members 21,22 move laterally relative to each other. The members can be actuated by any suitable means. For example, members 21,22 can each employ wheels, not shown, which travel on rails 24 so that members 21,22 move from the open position of FIG. 5 to the closed position of FIG. 1. Similarly, a rack and pinion arrangement could be employed if desired to move members 21,22 relative to opening 23. The rails 24 could be replaced by racks and suitable pinion gears could be attached to members 21,22.

Hangar 10 has a second or tail section 12 which is contiguous to back wall 15 of hangar section 11. Hangar tail section 12 comprises side walls 25,26 and back wall 27. Section 12 further includes front wall 28 and roof 29. Roof 29 is of a height which is greater than the height of the tail section of aircraft to be stored or maintained in hangar 10. FIGS. 2 and 3 show an outline of an aircraft positioned in hangar 10 with the wing and substantially all the fuselage of the craft located in hangar front section 11 and the tail section of the aircraft disposed in hangar section 12.

Referring to FIGS. 1–3, front wall 28 includes a retractable door 30 which comprises door members 31,32. Door 30 is adapted to be raised to the open position shown in FIG. 3 so that the tail section of the craft can pass through front wall 28. After the aircraft is in position, door 30 can be closed as shown in FIGS. 1 and 2.

For example, each end of a threaded shaft 33 can be fixed for rotation to the back of hangar wall 28. Door section 31 has a threaded nut **33*a* attached to the threaded rod or shaft 33. Upon rotation of shaft 33 by a suitable drive motor, the nut 33*a* travels vertically thereby causing door sections 31,32, which are pivotally connected to each other at 33*b*, to move to their open position as shown in FIG. 3. Rotation of shaft 33** in the opposite direction causes the door sections to close.

If desired, door 30 could be rolled up into an open position or the members could be hinged at their sides so that the door members 31,32 would pivot outwardly to an open position.

Figure 6:
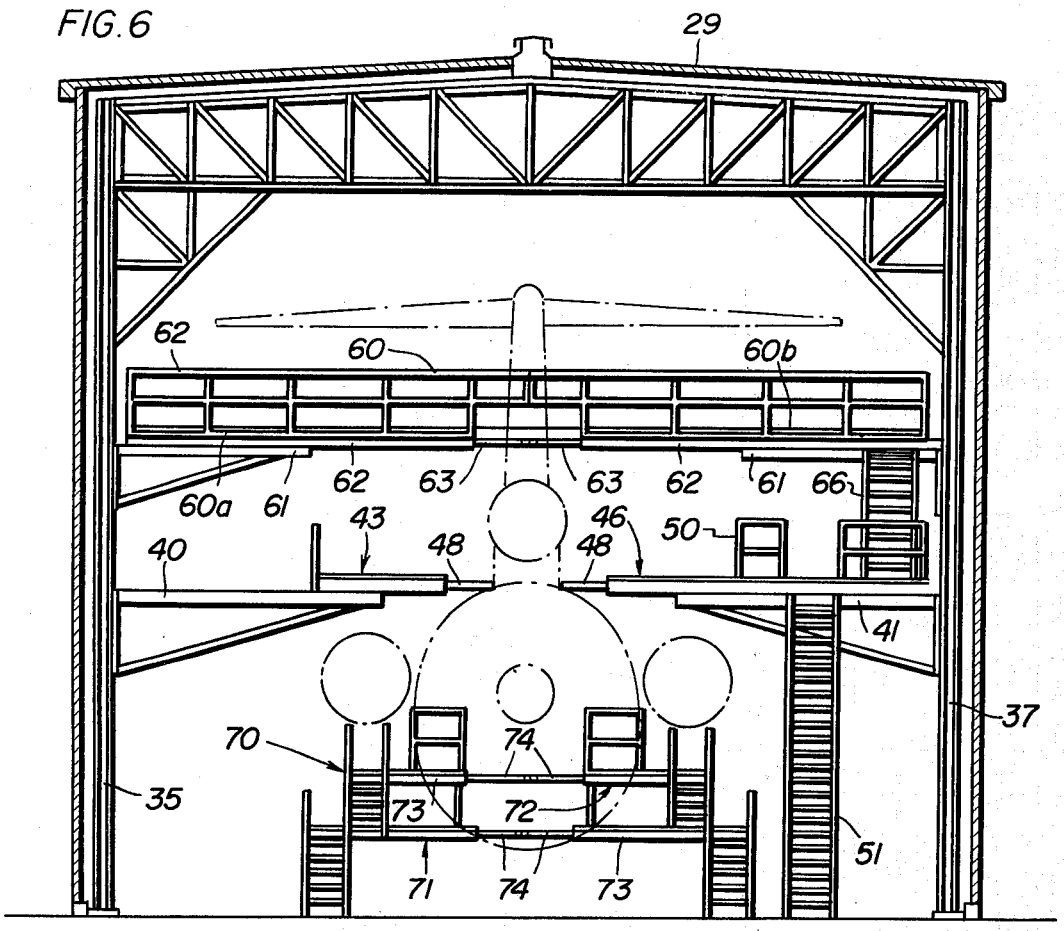
FIG. 6 shows a schematic section view of the hangar of the present invention and a tail section maintenance dock taken along lines 6—6 in FIG. 8.
Figure 7A:
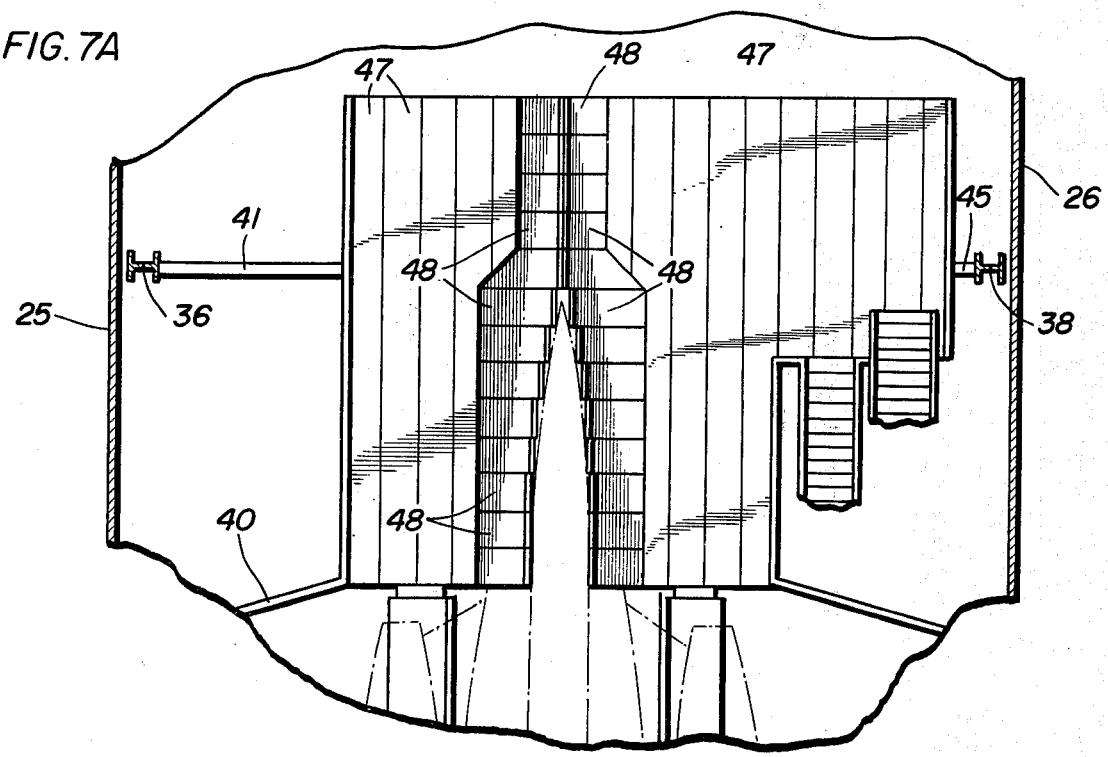
FIG. 7A shows a fragmentary section of a portion of the maintenance dock of FIG. 7 with the lateral deck plates adjusted about the tail section of an aircraft; and, FIG 8 shows a schematic side section of a maintenance dock taken along lines 8—8 in FIG. 7.
Figure 7:
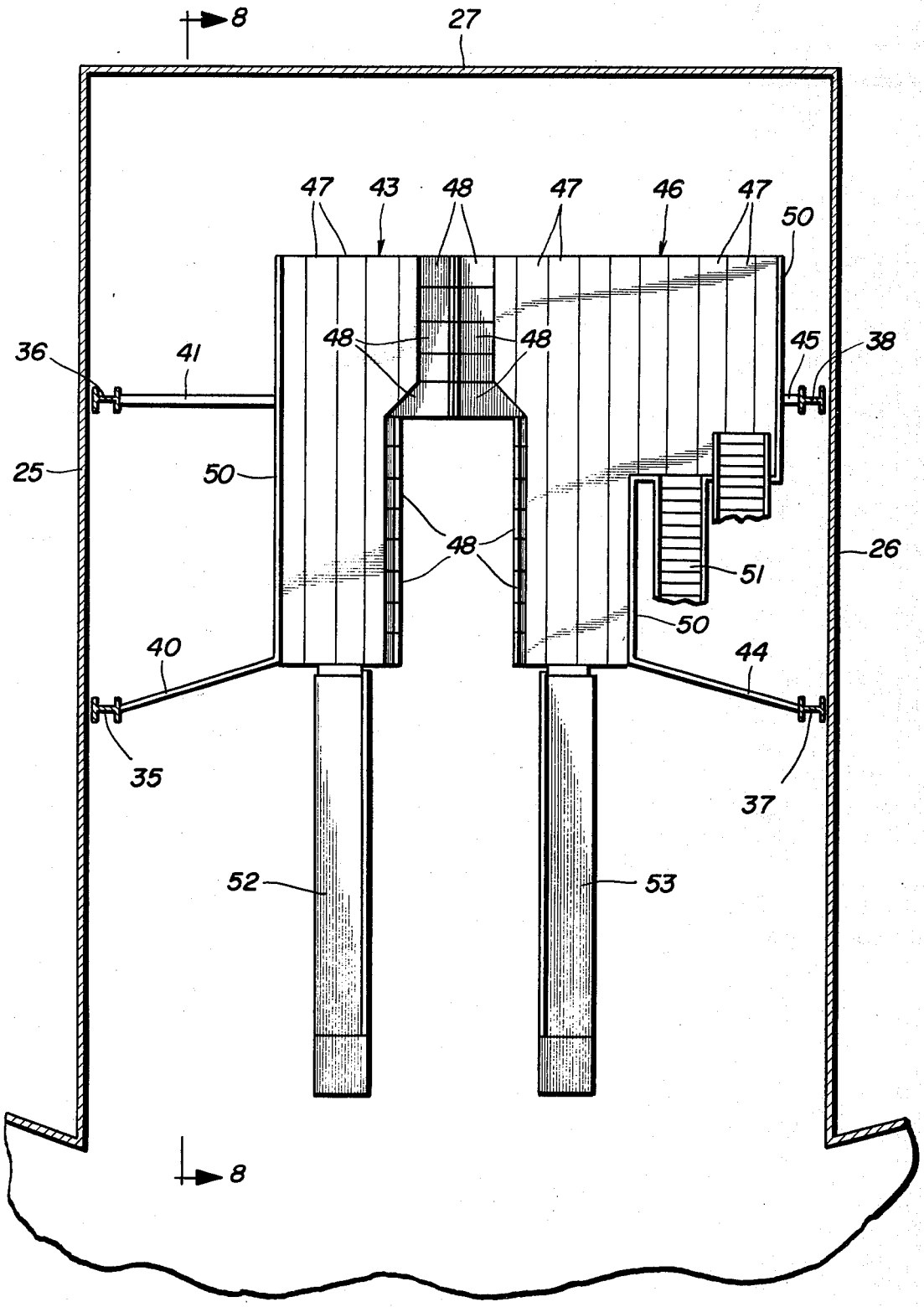
FIG. 7 shows a schematic plan section view of the tail section maintenance dock taken along line 7—7 in FIG. 8.
Figure 8:
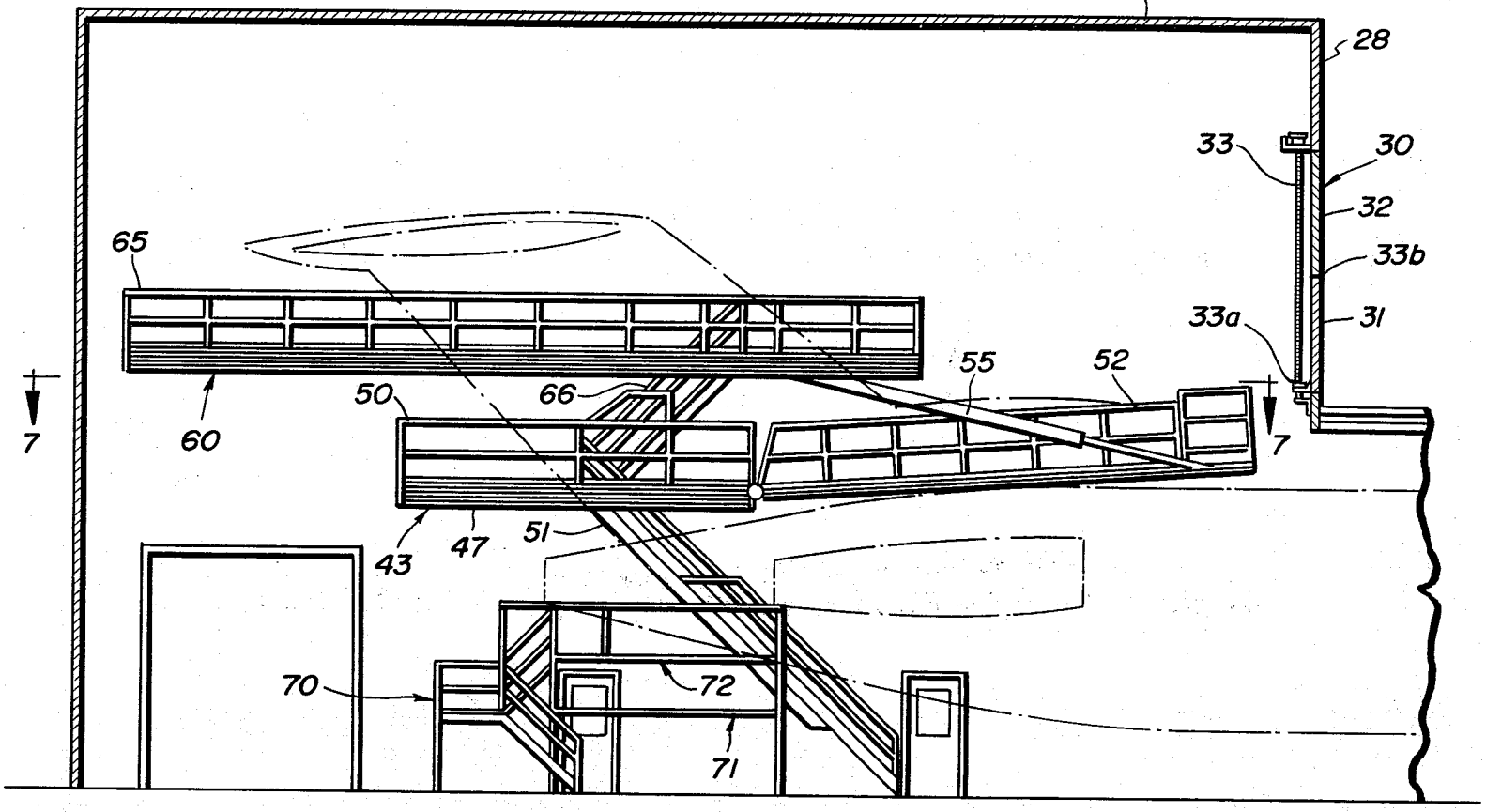

FIGS. 6–8 disclose schematic views of a tail section maintenance dock which can be utilized with the hangar facility of the present invention. FIGS. 6 and 7 disclose vertical column members 35,36,37,38 from which beam members extend laterally. Beams 40,41 serve to support lower deck assembly 43 while beams 44,45 are support members for lower deck assembly 46. Decks 43 and 46 each include deck plates 47 which are suitably attached, such as by welding, to the laterally extending beams. Additionally, plates 47 include laterally adjustable deck plates 48. Plates 48 can telescope into plates 47 so that the lower deck can be moved into position about the tail section of an aircraft, whereby maintenance and service personnel can gain access to the tail section. This is shown by FIGS. 6,7 and 7A, where plates 48 in FIG. 7 extend outwardly as shown in FIG. 7A to surround the tail section of an aircraft to be serviced.

Guide rails 50 are located at the edges of the lower deck assemblies 43 and 46 and stairs 51 permit access to the work deck. Decks 43 and 46 also include deck extensions 52,53, which are adapted to pivot about deck 47 and extend outward from deck 47 as schematically illustrated in FIG. 7 and partially shown in FIG. 8.

A top deck assembly 60, FIGS. 6 and 8, which includes decks **60*a*,60*b*, is located above deck assemblies 43,46. Decks 60*a* and 60*b*, like deck assemblies 43 and 46, each comprise a plurality of plates 62, which are joined to beam members 61. Members 61 are connected to columns 35–38**.

Decks **60*a* and 60*b* include adjustable plates 63 which telescope outwardly from plates 62 in the same manner as plates 48 telescope into plates 47. Appropriate guide rails 65 and stairs 66 to gain access to deck 60** are also employed.

Deck asemblies **43,46,60*a* and 60*b* can also be adjusted vertically. Beam members 40,41,44,45 and 61 can be moved vertically on columns 35–38** inclusive by any suitable means. For example, the beams can be raised and lowered hydraulically to the desired height.

A third tail section maintenance dock or station 70 is illustrated in FIGS. 6 and 8. Station 70 includes deck assemblies 71 and 72. Each deck includes plate members 73 with adjustable plate members 74. Deck 70 can be constructed of conventional scaffolding materials.

OPERATION

When maintenance work on an airplane is to be undertaken, hangar doors 19 on front walls 13,14 are opened by telescoping the sections 17 along tracks 18. Roof members 21,22 are moved as illustrated in FIG. 5 to expose opening 23 in roof 16. Additionally, door 30 on front wall 28 of hangar section 12 is actuated so that the door is in the open position shown in FIG. 3.

An aircraft to be serviced is then moved in position relative to hangar 10 so that the tail of the craft is aligned with opening 23 in roof 16. The craft is then backed into hangar 10 with the tail section of the aircraft entering the hangar first. The aircraft passes through hangar section 11 with the tail section of the craft (FIG. 5) extending above roof 16 at the opening 23. After the tail section moves through section 11 it passes through open door 30 into hangar 12. After the aircraft is properly positioned doors 9 on front walls 13,14 and door 30 on front wall 28, as well as roof members 21,22 can be closed.

Decks **43,46,60*a*,60*b*,71 and 72 can be adjusted as required to provide the proper work area with plate members, such as members 48, being moved into position in the manner shown in FIG. 7A. After the aircraft has been serviced, the plate members can be moved as required so that the tail section of the aircraft can exit from hangar section 12. Decks 43,46,60*a*,60*b*,71 and 72** need not be entirely disassembled in order to remove the aircraft from the hangar after the maintenance work has been completed.

Doors 9 and 30 and roof members 21,22 are again opened and the aircraft is pulled from the hangar with the nose of the craft exiting first.

For purposes of clarity and understanding and in order not to encumber the drawings, all the hangar structure, such as beams and trusses which are conventionally used, have not been shown. It is appreciated the hangar structure can be constructed from materials which are conventionally used and assembled and interconnected by methods well known to those skilled in the art.

The deck assemblies disclosed herein are available from R&D Constructors, Inc., 784 Busse Highway, Park Ridge, Illinois, and are disclosed in a brochure available from that company.

The foregoing detailed description has been given for clearness of understanding only and no unnecessary limitations should be understood therefrom, as modifications will be obvious to those skilled in the art.

What is claimed is:

1. A hangar for storing and maintaining aircraft, said hangar comprising:

a first fixed section for housing the fuselage and wing portions of an aircraft which includes a fixed roof having an opening therein through which a tail section of an aircraft can pass when an aircraft is moved into or out of said hangar; and, a second hangar section for housing the tail section of said aircraft said second section being contiguous to said first section and having a roof which is greater in height than the height of the roof of said first section and of a height sufficient to accommodate the height of the tail of an aircraft to be stored or maintained.

2. A hangar in accordance with claim 1 wherein said first section roof has at least one movable portion which is adapted to overlie said opening in said first section roof;

3. A hangar in accordance with claim 2 wherein said second section includes front wall having an opening therein through which the tail section of an aircraft can pass.

4. A hangar for storing and maintaining aircraft having a tail section, fuselage and wings, said hanger comprising:

a first fixed section comprising:

a pair of spaced walls, a fixed back wall and a roof having an opening therein through which a tail section of an aircraft can pass when it is moved into and out of said hangar;

a second section contiguous to said first section back wall, said second section comprising a pair of spaced side walls, a front wall and a back wall;

said front wall of said second section having an opening through which the tail section of an aircraft can pass;

said second section further including a roof section which is greater in height than the roof of said first section and of a height sufficient to accommodate the tail of a aircraft, whereby when an aircraft is moved into said hangar so that the tail section of said aircraft first enters said hangar, the tail of an aircraft will pass through said opening in said front roof and said opening in said front wall.

5. A hangar in accordance with claim 4 wherein said first section roof has at least one movable portion which is adapted to normally overlie said roof opening.

6. A hangar in accordance with claim 5 wherein said second front wall has a door means which can be opened for providing the opening in said front wall.

7. A hangar in accordance with claim 6 wherein said spaced walls of said first section include a pair of diverging front walls;

each front wall having a portion which is movable toward said back wall to allow said front walls to open to allow the wings of an aircraft to pass into or out of said front section.

8. A hangar in accordance with claim 7 and further including at least one adjustable tail section maintenance dock adjustably positioned in said second hangar section.

9. A hangar in accordance with claim 8 in which said maintenance dock includes means for adjusting said dock vertically and horizontally.

10. A hangar for storing and maintaining aircraft, said hangar comprising:

a first fixed section for housing the fuselage and wing portions of an aircraft which includes a roof having a movable portion to provide an opening in said fixed first section through which a tail section of an aircraft can pass when an aircraft is moved into or out of said hangar; and, a second fixed hangar section for housing the tail section of said aircraft, said second section being contiguous to said first section and having a roof of a height sufficient to accommodate the height of the tail of an aircraft to be stored or maintained.

11. A hangar for storing and maintaining aircraft having a tail section, fuselage and wings, said hangar comprising:

a first fixed section comprising:

a pair of spaced walls, a back wall and a fixed roof having a movable opening pad therein, through which a tail section of an aircraft can pass when it is moved into and out of said hangar;

a second fixed section contiguous to said first section back wall, said second section comprising a pair of spaced side walls, a front wall and a back wall;

said front wall of said second section having an opening through which the tail section of an aircraft can pass;

said second section further including a roof section of a height sufficient to accommodate the tail of an aircraft, whereby when an aircraft is moved into said hangar so that the tail section of said aircraft first enters said hangar, the tail of an aircraft will pass through said opening in said front roof and said opening in said front wall.

* * * * *

UNITED STATES PATENT AND TRADEMARK OFFICE

CERTIFICATE OF CORRECTION

PATENT NO. : 4,004,382

DATED : January 25, 1977

INVENTOR(S) : Carl V. Carlson

It is certified that error appears in the above-identified patent and that said Letters Patent are hereby corrected as shown below:

Column 2, line 63, following "hangar" insert --tail--; Column 6, line 2, "hanger" should be --hangar--; Column 6, line 28, following "second" insert --section--.

Signed and Sealed this

Third Day of May 1977

[SEAL]

*Attest:*

RUTH C. MASON
*Attesting Officer*

C. MARSHALL DANN
*Commissioner of Patents and Trademarks*